United States Patent [19]

Rogers

[11] 4,135,211

[45] Jan. 16, 1979

[54] RECTANGULAR COLOR CATHODE RAY TUBE BULB WITH INTEGRAL CORNER BOSSES FOR ENHANCED IMPLOSION PROTECTION

[75] Inventor: Melvin F. Rogers, Western Springs, Ill.

[73] Assignee: Zenith Radio Corporation, Glenview, Ill.

[21] Appl. No.: 772,625

[22] Filed: Feb. 28, 1977

[51] Int. Cl.[2] ..... H01J 29/87

[52] U.S. Cl. ..... 358/246; 220/2.1 A

[58] Field of Search ..... 358/246; 220/2.1 A

[56] References Cited

U.S. PATENT DOCUMENTS

| | | | |
|---|---|---|---|
| 3,490,636 | 1/1970 | Nienhuis | 220/2.1 A |
| 3,890,464 | 6/1975 | Hill | 358/246 |

*Primary Examiner*—Howard W. Britton

*Attorney, Agent, or Firm*—John H. Coult

[57] ABSTRACT

This disclosure depicts an implosion-protected, rectangular-type color cathode ray tube bulb comprising a rectangular glass faceplate of the type having a viewing window and a flange extending rearwardly therefrom, to which flange is sealed a mating funnel. The bulb has a tension band system very tightly constricting said flange so as to provide implosion protection for the bulb by compressively pre-loading the corners of the faceplate flange. The bulb is characterized by having on the outside of the faceplate flange at each corner and molded integrally with the flange, an incompressible load-concentrating boss for significantly reducing the corner area on which the load is applied by the tension band. By this expedient, the level of the compressive stresses generated in the flange at the flange corners and the resultant implosion protection provided by the tension band system is greatly enhanced.

4 Claims, 2 Drawing Figures

RECTANGULAR COLOR CATHODE RAY TUBE BULB WITH INTEGRAL CORNER BOSSES FOR ENHANCED IMPLOSION PROTECTION

BACKGROUND OF THE INVENTION

This invention relates to an improved implosion protection system for a color-cathode ray tube bulb. A conventional color cathode ray tube bulb includes a faceplate with a rearward flange and a funnel sealed to the faceplate flange along a planar sealing interface. Due to the high vacuum in the bulb, several tons of atmospheric pressure are exerted on the bulb, causing it to be susceptible to implosion. (The term "implosion" is defined by Underwriters Laboratory Inc. as a "rapid and sudden inward bursting of a high-vacuum glass envelope.") It is of utmost importance in the interest of safety to prevent the bulb from violently imploding should it, for example, be struck by a heavy missile. There have evolved a number of approaches to implosion protecting color cathode ray tube bulbs of the type described having a flanged faceplate. A first approach seeks to confine and restrain the shards of a fractured faceplate — typically by the use of a circumscribing frame which is cemented to the faceplate flange with an epoxy cement. This is the so-called "rimbond" type implosion protection system.

A second approach involves the use of a split frame which fits over the faceplate flange and which is constricted tightly against the flange by means of a tension band. The frame may be "wet", that is, cemented to the faceplate flange, or "dry".

A third approach involves laminating a transparent protective shield over the viewing window of the faceplate.

A fourth approach, and the one with which this invention is concerned, is the so-called "tension band" approach. Implosion protection is provided in conventional tension band systems by one or more high tension bands which are placed around the faceplate flange and drawn up to a very high tension, for example, 1500–2000 p.s.i. The principle of operation is not primarily one of confinement, as in rimbond systems, but one of pre-load. By compressively pre-loading the faceplate flange, the implosion-induced tensive stresses in the faceplate must first overcome the compressive prestresses in the faceplate before the faceplate will fracture.

Tension bands implosion systems are popular commercially, in applications where they are efficacious, because of their low cost. They do, however, have a number of serious shortcomings. They suffer from their provision of only marginal implosion protection in certain applications; in other applications they are completely impotent. Specifically, it has been found that tension band systems are completely inadequate in providing implosion protection on bulbs of certain sizes and configurations. Examples of prior art United States patents issued on various aspects of tension band systems are Nos. 3,818,557; 3,456,076; 3,556,306; 3,597,537; 3,777,057; 3,845,530; and 3,890,464.

U.S. Pat. No. 3,605,227-Nienhuis et al depicts an implosion protection system of the tension band type in which an "annular strap" (band) of the same size or slightly larger than the circumference of the faceplate flange is placed about the faceplate flange (Col. 1, line 60). Tension is introduced in the band, allegedly without the disadvantages of non-uniform tensile force distribution found in prior art systems, by driving cushioned "wedge-shaped parts" between the strap and the outer surface of the faceplate flange (Col. 1, line 65). The wedge-shaped parts and the strap are preferably then affixed to the glass as by the use of a cement such as a hardening synthetic resin which is cast in the spaces between the wedge-shaped parts and the glass (Col. 1, line 72). This prevents the dislodging of the wedges by shocks and the like, it is said.

A wedge-shaped part is illustrated at a corner of the faceplate (Nienhuis FIG. 2), but it is said that the parts are "preferably arranged at the center of the straight sides or are distributed uniformly over the straight sides, since the force required for inserting the wedges to obtain a given tensile force in the strap may be comparatively small. Moreover, an additional pressure is then exerted on the glass along the straight sides, which has a favorable influence on the reinforcement of the glass surface of these flat sides located between mold match line and the front of the window" (Col. 2, line 15).

Placement of the wedge-shaped part at the center of the straight sides has a third advantage, it is said: the strap is spaced from the glass by a larger distance which facilitates the casting of adhesive and filler materials (Col. 2, line 27).

OBJECTS OF THE INVENTION

It is an object of the present invention to provide for a color television picture tube bulb of the conventional type having a faceplate with a rearward flange, an improved implosion protection system.

Specifically, it is an object to provide for a color-television picture tube bulb an implosion protection system of the tension band type which provides greatly improved implosion protection at no increased cost over that of a standard tension band system.

OTHER PRIOR ART 3,825,413-Schwartz
3,490,636-Nienhuis et al
2,871,087-Knochel
3,071,280-Mayhew et al

BRIEF DESCRIPTION OF THE DRAWINGS

The features of the invention which are believed to be novel are set forth with particularly in the appended claims. The invention, together with further objects and advantages thereof, may be best understood, however, by reference to the following description taken in conjunction with the accompanying drawings and in which:

DESCRIPTION OF THE PREFERRED EMBODIMENTS

Figure 1:
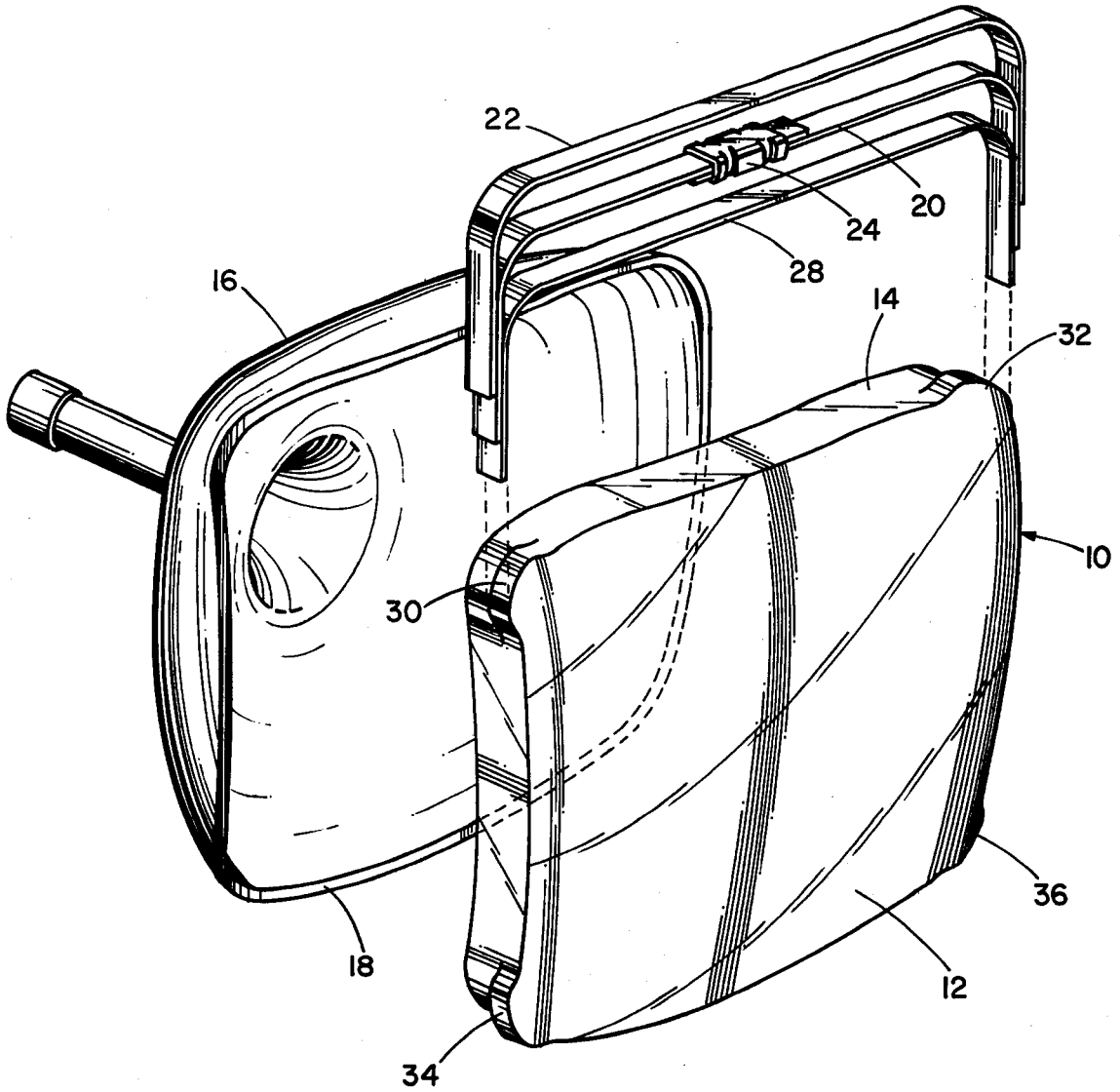
FIG. 1 is an exploded schematic perspective view of a color cathode ray tube bulb having the improved implosion protection system of this invention installed thereon.
Figure 2:
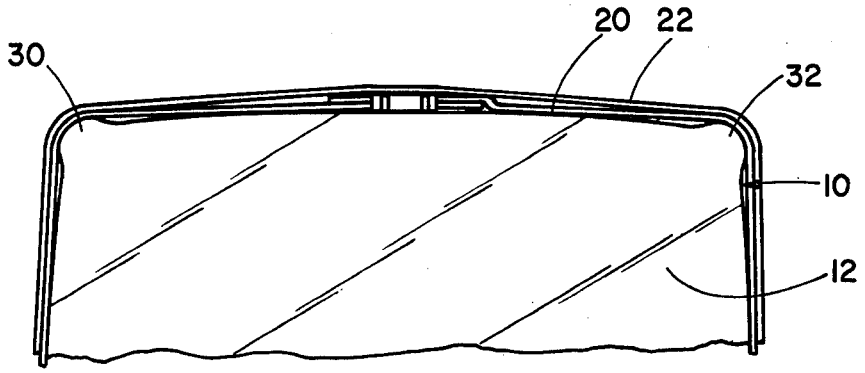
FIG. 2 is fragmentary front elevation view of the FIG. 1 tube, showing the improved implosion protection system in its proper installed position.

FIGS. 1–2 illustrate a colar cathode ray tube bulb embodying the present invention. The bulb is of the type comprising a rectangular glass faceplate 10 having a viewing window 12 and a flange 14 extending rearwardly from the viewing window 12.

A mating funnel 16 has a seal land 18 which is sealed to a corresponding seal land (not shown) on the back side of the faceplate flange 14. Sealing is typically accomplished by the use of a devitrifying glass cement or "frit". A tension band system of any of a variety of well known types may be employed in the practice of this invention. The tension band system which is preferred is a double band system comprising first and second tension bands 20, 22 which are wrapped and drawn up tight in sequence, one overlaid on the other. The tension bands 20, 22 are made of a high grade steel. Heavy duty clips which maintain the tension in the bands are located on opposite sides of the bulb. Only the clip (24) for band 20 is shown.

A vinyl or friction tape 28 may be placed beneath the bottom band 20 in order to prevent scratching of the outer surface of the flange 14 and to cushion the mold line customarily circumscribing the flange. As alluded to briefly in the above Background of the Invention, conventional tension band implosion protection systems have been found to be efficacious only on certain tube sizes and configurations. For example, it has been found that whereas a double tension band system can provide adequate implosion protection systems on certain 25V(25 inch diagonal) tubes having a highly rectangularized faceplate and a modest deflection angle (90°, for example) the same system will not provide adequate implosion protection for a similar 23 inch diagonal tube having the same deflection angle but a somewhat less rectangularized faceplate configuration.

The deflection angle for the tube is important since the funnels of tubes having wide beam deflection angles (100° or 110°, for example), are weaker than those of tubes having smaller beam deflection angles. The weaker the funnel, the more integrity must the implosion protection system have. Summarizing, a stronger implosion protection system must be employed in a tube having a wide deflection angle or a bluntly rectangular faceplate than in a like tube having a narrower deflection angle or a more sharply rectangularized faceplate configuration.

In accordance with the present invention, means are provided which so enhance the implosion protection provided by a tension band system that certain bulbs which could not previously be adequately protected by a tension band system now can be. In other applications of this invention, a tension band system providing only marginal implosion protection is improved to the point where it has a reserve of protection.

As noted, the impetus toward the use of dry tension band systems, as opposed to rimbond or other type implosion systems, is the very significant cost saving involved. The cost savings involved in using a dry tension band system, as opposed to a rimbond system may, for example, amount to $1.00 or more per tube.

Conventional tension band implosion protection systems, as described, function by compressively pre-loading the faceplate flange — particularly the corners thereof. In accordance with the present invention, the degree of implosion protection provided by a tension band system is greatly enhanced by the provision of an incompressible glass boss which is molded integrally on the outside of the faceplate flange at each corner for significantly reducing the corner area on which the load is applied by the tension band system. In FIGS. 1–2, four corner bosses provided according to this invention are shown at 30, 32, 34 and 36. The bosses act to concentrate the load applied by the tension band system at narrow regions on the corners of the faceplate flange. The level of the compressive stress generated in the flange at the flange corners and the resultant protection provided by the tension band system is thereby greatly enhanced.

Although numerous configurations of the integral glass bosses are contemplated, the illustrated preferred bosses 30–36 each have an outer surface 38 with a radius corresponding to the radius of the outer surface 40 of the supporting flange corners. The boss outer surface 38 is tangentially brief, that is, it has a very limited extent in the azimuthal direction around the periphery of the tube. The surface 38 is displaced radially outwardly from at least a portion of the outer surface 40 of the flange.

It is clear then that the very great tensile forces developed in the tension band system (here the double tension bands 20, 22) is applied in a four point geometry on the diagonals of the flange and concentrates the compressive loadings applied to the flange on a very limited area at the faceplate corners so as to increase the internal compressive stresses generated within the flange corners. It has been discovered, for example, that a 23V color cathode ray tube bulb with a 90° deflection angle which could not be made to pass the implosion tests of the Underwriters Laboratory Incorporated with a commercial double tension band system, passed the same tests when bosses according to my invention were placed on the corners of the faceplate flange, essentially as shown in FIGS. 1–2.

The invention is believed to have applicability even on bulbs with highly rectangularized faceplate configurations if those bulbs are part of tubes with wide beam deflection angles (and thus weak funnels).

The bosses 30, 32, 34 and 36 may have configurations other than as shown in the illustrated FIGS. 1–2 embodiment. For example, the outer surface of each boss may have a different radius (preferably sharper) than the radius of the outer surface of the associated flange corner. Any boss configuration which has the described effect of localizing and concentrating the compressive loads applied by the tension band system will further the objects of the present invention.

While particular embodiments of the invention have been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

What is claimed is:

1. An implosion-protected, rectangular-type color cathode ray tube bulb comprising a rectangular glass faceplate of the type having a viewing window and a flange extending rearwardly therefrom, to which flange is sealed a mating funnel, said bulb having a tension band system very tightly constricting said flange so as to provide implosion protection for the bulb by applying a compressive loading to the corners of the faceplate flange, said bulb being characterized by having on the outside of the faceplate flange at each corner and molded integrally with the flange, an incompressible load-concentrating boss for significantly reducing the corner area on which said tension band system applies its load, whereby the level of the compressive stresses generated in the flange at the flange corners and the resultant implosion protection provided by the tension band system is greatly enhanced.

2. A rectangular-type color cathode ray tube bulb with improved implosion protection, comprising a rectangular glass faceplate having a viewing window and a flange extending rearwardly therefrom, to which flange is sealed a mating funnel, said bulb having on the outside of the faceplate flange at each corner and molded integrally therewith, an incompressible, load-concentrating boss, said bulb having a four point, diagonally loading dry tension band system which surrounds said flange and is displaced radially outwardly from at least a portion of the outer surface of the flange corners by said four integral glass bosses, said system applying a very high, concentrated compressive loading on the corners of said flange through said bosses so as to provide enhanced implosion protection for the bulb.

3. The color cathode ray tube bulb defined by claim 2 wherein each of said bosses has an outer surface with a radius corresponding to the radius of the outer surface of the supporting flange corner.

4. An implosion-protected, rectangular-type color cathode ray tube bulb comprising a rectangular glass faceplate of the type having a viewing window and a flange extending rearwardly therefrom, to which flange is sealed a mating funnel, said bulb having a dry double tension band system comprising two overlaid steel tension bands very tightly constricting said flange so as to provide implosion protection for the bulb by applying a compressive loading to the corners of the faceplate flange, said bulb being characterized by having on the outside of the faceplate flange at each corner and molded integrally with the flange, an incompressible load-concentrating boss, said boss having an outer surface with a radius corresponding to the radius of the outer surface of the supporting flange corner, said boss surface being tangentially brief and radially outwardly displaced from said outer surface of said flange corner so as to off-set said tension band system from at least a portion of said outer surface of said flange, said boss significantly reducing the corner area on which said tension band system applies its load, whereby the level of the compressive stresses generated in the flange at the flange corners and the resultant implosion protection provided by the tension band system is greatly enhanced.

* * * * *